US005162004A

United States Patent [19]

Kuzuno et al.

[11] Patent Number: 5,162,004

[45] Date of Patent: Nov. 10, 1992

[54] MULTI-TERMINAL ELECTRIC CONNECTOR REQUIRING LOW INSERTION AND REMOVAL FORCE

[75] Inventors: Katsutoshi Kuzuno; Shigeo Ishizuka; Kazuaki Sakurai, all of Shizuoka, Japan

[73] Assignee: Yazaki Corporation, Tokyo, Japan

[21] Appl. No.: 727,216

[22] Filed: Jul. 9, 1991

Related U.S. Application Data

[62] Division of Ser. No. 523,682, May 15, 1990, Pat. No. 5,061,197.

[30] Foreign Application Priority Data

May 19, 1989 [JP] Japan ..... 1-124280
May 22, 1989 [JP] Japan ..... 1-126789

[51] Int. Cl.[5] ..... H01R 13/11

[52] U.S. Cl. ..... 439/845; 439/850; 439/856; 439/867

[58] Field of Search ..... 439/856, 857, 858, 861, 439/862, 866, 867, 834, 836, 262, 263, 265, 845, 849, 850, 881, 877, 878, 882

[56] References Cited

U.S. PATENT DOCUMENTS 3,120,990 2/1964 Kinkaid ..... 439/849 X
3,299,396 1/1967 Kinkaid ..... 439/862
3,310,773 3/1967 Baenziger et al. ..... 439/881
3,729,701 4/1973 Smith ..... 439/858
3,846,735 11/1974 Carter et al. ..... 439/857 X
4,453,799 6/1984 Inoue ..... 439/857 X
4,530,870 9/1985 Thewlis ..... 339/75 M

FOREIGN PATENT DOCUMENTS 2332556 8/1987 Fed. Rep. of Germany .
8162141 2/1989 Fed. Rep. of Germany .

*Primary Examiner*—Larry I. Schwartz
*Assistant Examiner*—Julie R. Daulton
*Attorney, Agent, or Firm*—Sughrue, Mion, Zinn, Macpeak & Seas

[57] ABSTRACT

An electric connector requiring decreased insertion and withdrawal force, even when including groups of 20 to 40 terminals. The connector includes a male portion, a female portion into which the male portion fits, and a cam mechanism. With the cam mechanism, the male casing fitted in a covering portion of the female casing may be slid horizontally between its original fitting position and a male and female terminal contact position, parallel to the fitting surface of the female casing, so as to slide the male and the female terminals out of or into contact with each other with less force than was required previously.

4 Claims, 15 Drawing Sheets

MULTI-TERMINAL ELECTRIC CONNECTOR REQUIRING LOW INSERTION AND REMOVAL FORCE

This is a divisional of application Ser. No. 07/523,682 filed May 15, 1990, now U.S. Pat. No. 5,061,197 issued Oct. 29, 1991.

BACKGROUND OF THE INVENTION

The present invention relates to a multi-terminal electric connector requiring a low insertion and removal force, in which a male casing fitted in a female casing is slid horizontally parallel to the fitting surface of the female casing by using a push member, to put male and female terminals into and out of contact with each other.

In a conventional multi-terminal electric connector such as shown in FIGS. 20 and 21, a male casing 100 is inserted into and withdrawn from a female casing 101 in the same direction as male terminals 103 are inserted into and withdrawn from female terminals 102. The female terminal 102 has an elastic contact member 104 and the male terminal 103 has a tab-like portion 105. In the illustrated structure, the length Lf of the mutual fitting stroke of the male and the female terminals 103 and 102 needs to be equal to the sum of the length $L_1$ of the body portion of the elastic contact member 104 and the length $L_2$ of the tip portion thereof.

If the force for inserting the male casing 100 into the female casing 101 to connect each pair of male and female terminals 103 and 102 to each other is about 500 g, the total of the forces for 20 pairs of male and female terminals 103 and 102 is about 10 kg ($=20\times500$ g). Besides, a locking force needs to be applied to both the male and the female casings 100 and 101. As a result, it is difficult to fit the male and the female casings 100 and 101 to each other by human hands.

A screw-tightened multi-terminal electric connector, for which a screw tightening force and a tool such as an impact wrench are utilized, then was proposed for 60 to 90 pairs of male and female terminals, as disclosed in Japanese Patent Applications (OPI) Nos. 149612/87 and 188188/87 (the term "OPI" as used herein means in "unexamined published application") However, if a screw tightening force and a tool such as an impact wrench are utilized for a screw-tightened multi-terminal electric connector having about 20 to 40 pairs of male and female terminals, the cost of the connector per pair of terminals is so high, because of the embed-molding of bolts and nuts and so forth, that it is difficult to provide the connector for practical use.

In a multi-terminal electric connector having about 20 to 40 pairs of male and female terminals, as disclosed in Japanese Patent Application (OPI) No. 203581/86, male and- female casings and the male and the female terminals are fitted to each other by utilizing a cam following slide. However, since the male and the female terminals are fitted to each other in the longitudinal directions thereof as shown in FIGS. 20 and 21, insertion of the male casing into the female casing, and removal of the male casing from the male casing still require a large force.

SUMMARY OF THE INVENTION

The present invention was made in order to solve the above-mentioned problems. Accordingly, it is one object of the invention to provide a multi-terminal electric connector, requiring low insertion and removal forces, which is appropriate for about 20 to 40 pairs of male and female terminals and in which the male terminals can be inserted into and pulled out of the female terminals using a low force.

The connector includes a male casing housing the plural female terminals, a female casing housing the plural male terminals and having a covering portion, into which the male casing is inserted, and a cam mechanism, which acts so that the male casing fitted in the covering portion of the female casing is slid horizontally between the fitting position and a male and female terminal contact position, parallel to the fitting surface of the female casing, to put the male and the female terminals out of or into contact with each other.

The cam mechanism includes a push member having a cam rod. The cam rod has an intermediate portion having an oblique removal surface and an oblique insertion surface. The male and the female casings have cam holes, which communicate with each other along the axial directions of the male and the female terminals. The cam hole of the male casing is defined by slide contact portions corresponding to the oblique insertion and removal surfaces of the cam rod.

The female terminals have electroconductive contact portions, into which the tab-like portions of the male terminals are inserted perpendicularly across the axes of the female terminals. The cam rod is inserted into the cam hole of the male casing fitted in the covering portion of the female casing, so that the slide contact portion corresponding to the inserting oblique surface is pushed by the surface to slide the male casing horizontally, so as to put the electroconductive contact portions of the female terminals into electroconductive contact with the tab-like portions of the male terminals.

The cam rod is pulled outwardly relative to the cam holes of the male and the female casings, so that the slide contact portion corresponding to the oblique removal surface is pushed by that surface to slide the male casing horizontally in the reverse direction to the former horizontal sliding thereof so as to put the male and the female terminals out of electroconductive contact with each other.

It is preferable to provide locking structure between the male and the female casings in order to prevent the male casing from separating from the female casing when the male casing fitted in the covering portion of the female casing is slid horizontally. Also, it is preferable that a tentative locking device be provided between the push member and the male or female casing in order to prevent the push member from coming out of the cam hole of the male or female casing after being inserted into the cam hole.

Further, it is preferable that a fitting confirmation member be inserted into an opening made between the male casing and the cover portion of the female casing when the male casing is slid horizontally by manipulating the push member, in order to prevent incomplete fitting of the male and the female casings. The fitting confirmation member may be provided separately from the male and the female casings, in the state of being joined to the male or female casing by a coupler, or may be handled together with the male casing under the action of a locking device.

The direction of the fitting of the male and female casings of the inventive multi-terminal electric connector extends perpendicularly across the direction of insertion of the male terminal into the female terminal.

The force for fitting the male casing into the covering portion of the female casing, and the force for pulling the male casing out of the covering portion are only slightly higher than the force for locking the male and the female casings to each other and the force for unlocking them from each other, respectively.

Putting the male and the female terminals into and out of electroconductive contact with each other by sliding the male casing horizontally into the female casing is performed on the basis of the sliding cam actions of the cam mechanism, which are caused by the oblique insertion and removal surfaces of the cam rod of the push member and the oblique surfaces defining the cam hole of the male casing or the insertion and the removal projections provided on the oblique surfaces. As a result, the force for inserting the male terminals into the female terminals and the force for pulling the male terminals out of the female terminals are lower than those for a conventional multi-terminal electric connector.

It is another object of the present invention to provide, in an electrical connector, a female terminal having an electroconductive contact portion such that: the female terminal can be electrically connected to a male terminal by a small-length stroke for fitting both the terminals to each other; the male terminal can be inserted into and pulled out of the female terminal with little force, the area and pressure of contact of both the terminals are large, and the electroconductive contact portion is particularly appropriate for an electric connector having about 20 to about 40 pairs of male and female terminals.

The female terminal is made from a thin metal sheet, and includes the electroconductive contact portion located at one part of a base plate so as to receive the tab-like portion of the male terminal into the electroconductive contact portion, and an electric wire connecting portion at the other part of the base plate. The electroconductive contact portion of the female terminal is composed of the base plate, side walls at both side edges of the base plate, and an elastic contact part formed by bending at least one of the side walls toward the other of them in the form of U. The tab-like portion of the male terminal is inserted between the elastic contact part and the latter side wall in a direction crossing the surface of the base plate perpendicularly.

If the male terminal is connected to an electric wire, the electroconductive contact portion of the male terminal is formed as the tab-like portion by bending one free side edge part of the base plate of the male terminal back onto another part of the base plate so that the tab-like portion can be inserted into the electroconductive contact portion of the female terminal, starting with the part of the tab-like portion, which is located opposite the bent-back part of the tab-like portion.

The electroconductive contact portion of the female terminal provided in accordance with the invention is constituted so that the tab-like portion of the male terminal is inserted into and removed from the electroconductive contact portion in directions crossing the surface of the base plate of the female terminal perpendicularly.

The direction of each of the insertion and removal of the male terminal into and from the female terminal crosses that of the fitting of the male and female casings of the connector perpendicularly, unlike a conventional female terminal into and from which a male terminal is inserted and removed along the axial directions thereof. For that reason, the length of the stroke for fitting the male terminal and the female terminal provided in accordance with the invention, and the length of the electroconductive contact portion of each of them can be shortened. Besides, the contact portions of the male and the female terminals can be enlarged so as to make their electric connection more stable.

BRIEF DESCRIPTION OF THE DRAWINGS

The foregoing and other features and advantages of the inventive connector will be described in detail below with reference to preferred embodiments thereof, described in detail with reference to the accompanying drawings, in which:

FIGS. 11A, 11B, 11C, 11D and 11E are sectional views for describing the states of the connector shown in FIG. 10A;

DETAILED DESCRIPTION OF THE PREFERRED EMBODIMENTS

Figure 1A:
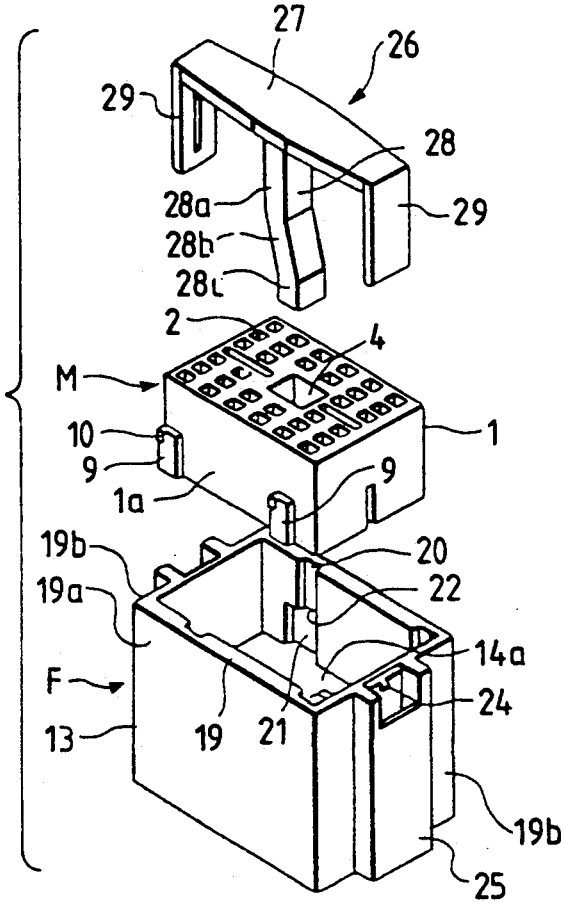
FIGS. 1A and 1B are perspective exploded views of one embodiment of a multi-terminal electric connector according to the invention.
Figure 1B:
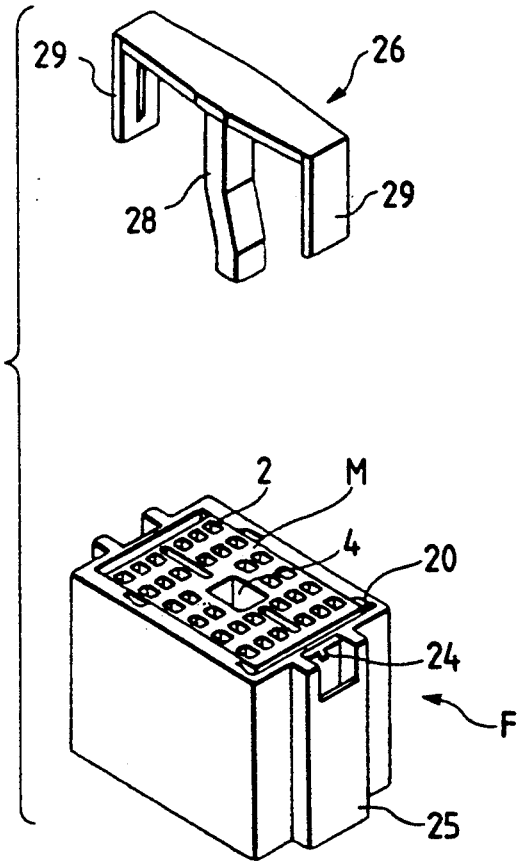
Figure 1C:
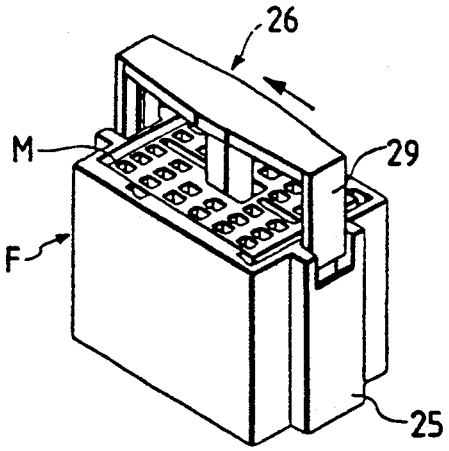
FIGS. 1C and 1D are perspective views of the connector of FIGS. 1A and 1B.
Figure 1D:
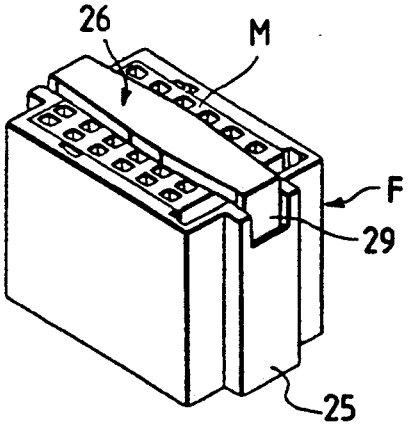

Embodiments of the present invention now will be described in detail with reference to the accompanying drawings.

FIGS. 1A, 1B, 1C and 1D are perspective views of a first embodiment of the connector in various stages of fitting, and FIGS. 2A, 2B, 2C and 2D are corresponding sectional views of the connector. The connector includes a male unit M, a female unit F, and a push member 26 fitting both the units to each other to connect them electrically. The male unit M has female terminals 40 in female terminal chambers. The female unit F has male terminals 32 in male terminal chambers. The number of the male and the female terminals 32 and 40 shown in FIGS. 2A, 2B, 2C and 2D is less than the actual number, for simplification of the drawings.

The male casing 1 of the male unit M has a plurality of female terminal chambers 2. A cam hole 4 is provided in the center of the casing 1. The chambers 2 are open at the top and bottom of the male casing 1. Engagement projections 3 are provided in the chambers 2. The cam hole 4 extends through the casing 1 from the top thereof to the bottom thereof. The cam hole 4 is defined by a first inside surface including a vertical portion **4*a* and an oblique portion 4*b*, and a second inside surface including a vertical portion 4*c*, an oblique portion 4*d*, and a vertical portion 4*e* and facing the first inside surface. An upper wide portion 5 of the cam hole 4 is defined by the vertical portions 4*a* and 4*c*. A lower narrow portion 6 of the cam hole 4 is defined by the vertical portions 4*a* and 4*e* and the oblique portions 4*b* and 4*d***.

At the boundary of the upper and lower portions 5 and 6, an inserting projection 7 is provided on the oblique portion **4*d*, and a pulling-out projection 8 is provided on the vertical portion 4*a*, so that a cam rod 28 of a push member 26 is put into sliding contact with both the projections 7 and 8, as described hereinafter. The male casing 1 also has upward movement preventive juts 9 which are provided on both longitudinal sides 1*a* of the casing at or near both ends and near the bottom thereof so as to prevent the casing from moving upwardly relative to a female casing 13** of the female unit F.

The laterally central portion of the bottom **1*b* of the male casing 1 has a tentative engagement groove 11 and a stationary engagement groove 12 which are provided at an appropriate distance from each other. The juts 9 have withdrawal preventive projections 10 which are provided thereon at the left-hand upper outer corners of the juts in FIG. 1A so as to prevent the male casing 1 from being withdrawn from the female casing 13. The tentative engagement groove 11 is provided at the left-hand end of the male casing in FIG. 2A so that the distance between the tentative and stationary engagement grooves 11 and 12 is equal to the length of the horizontal sliding of the male casing in the female casing 13**, as will be described in detail hereinafter.

The body 14 of the female casing 13 of the female unit F has a covering portion 19 which constitutes the fitting surfaces **14*a* of the body 14 and into which the male unit M is inserted. The body 14 has the plural male terminal chambers 15 which correspond to the male unit M and among which a cam hole 16 is provided in the central portion of the body. The cam hole 16 extends through the casing body 14 from top to bottom thereof so that the cam hole communicates with the cam hole 4 of the male casing 1** of the male unit M when the male unit M is inserted into the female unit F.

An upper wide portion 17 of the cam hole 16 is defined by a vertical inside surface **16*a* and a facing oblique inside surface 16*b*. A lower narrow portion 18 of the cam hole 16 is defined by the vertical inside surface 16*a* and another facing oblique inside surface 16*c*. Both longitudinal inside surfaces 19*a* of a covering portion 19 have guide grooves 20 and upward movement preventive grooves 21 near both ends of the covering portion 19, so that the guide grooves 20 are located over the upward movement preventive grooves 21** and are continuous therewith.

A locking part 22 is provided between each pair of guide grooves 20 and upward movement preventive grooves 21 so as to be engaged with the corresponding withdrawal preventive projection 10. The upward movement preventive jut 9 is put into the corresponding guide groove 20. The upward movement preventive groove 21 allows the upward movement preventive jut 9 to move rightwardly and leftwardly in the longitudinal direction of the female unit F. An engagement projection 23, which is engaged with the tentative engagement groove 11 of the male unit M or the stationary engagement groove 12 thereof, is provided at one end **21*a* of one of the upward movement preventive grooves 21 provided in each longitudinal inside surface of the covering portion 19. Locking claws 24 project from the central parts of the right and left ends 19*b* of the covering portion 19 at the tops of the central parts. Channel-shaped arm guides 25 are provided on the right and left ends 19*b* of the covering portion 19 and extend from the top of the casing body 14** to the bottom thereof.

Figure 2B:
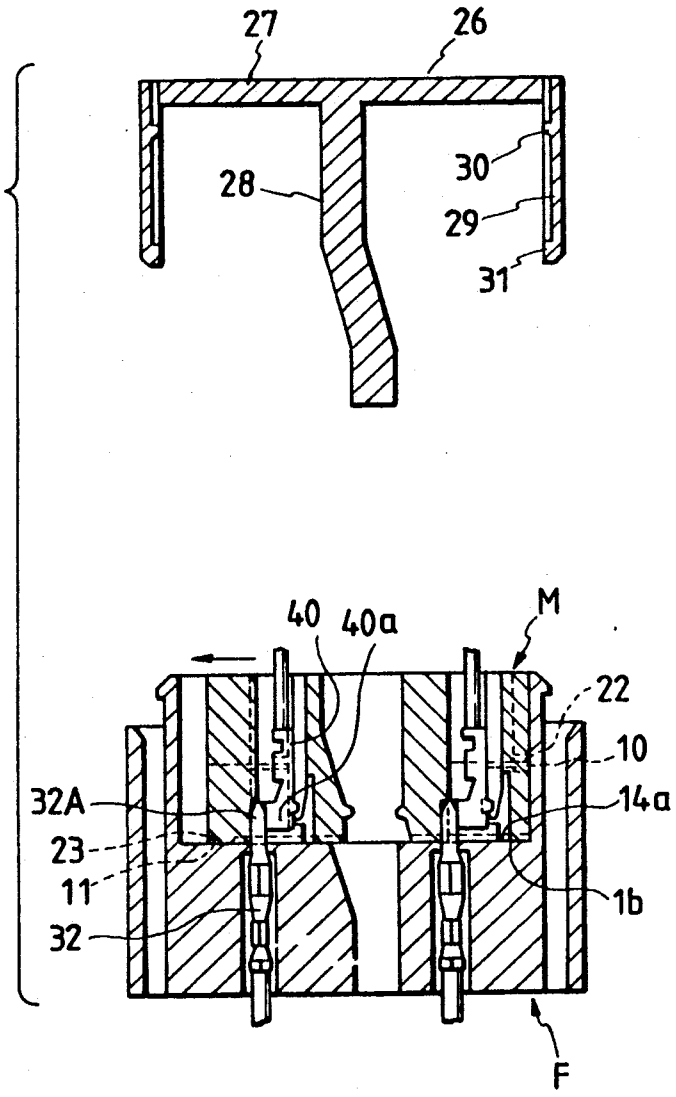
FIGS. 2A, 2B, 2C and 2D are sectional views of the connector, which correspond to the respective views in FIGS. 1A, 1B, 1C and 1D.
Figure 2A:
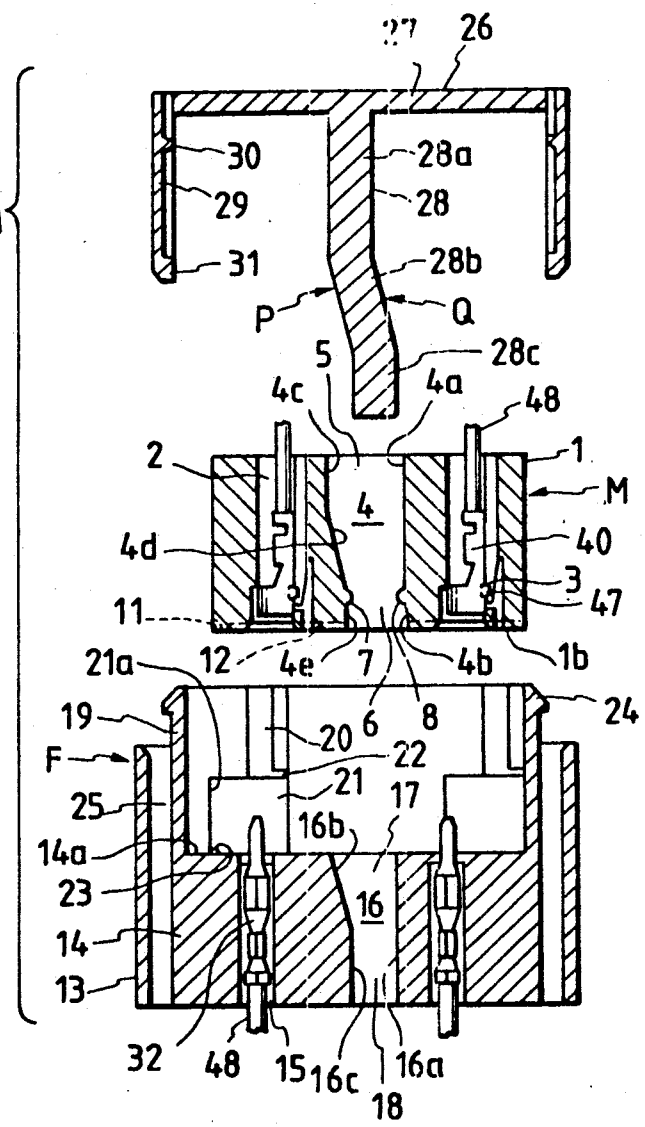
Figure 3:
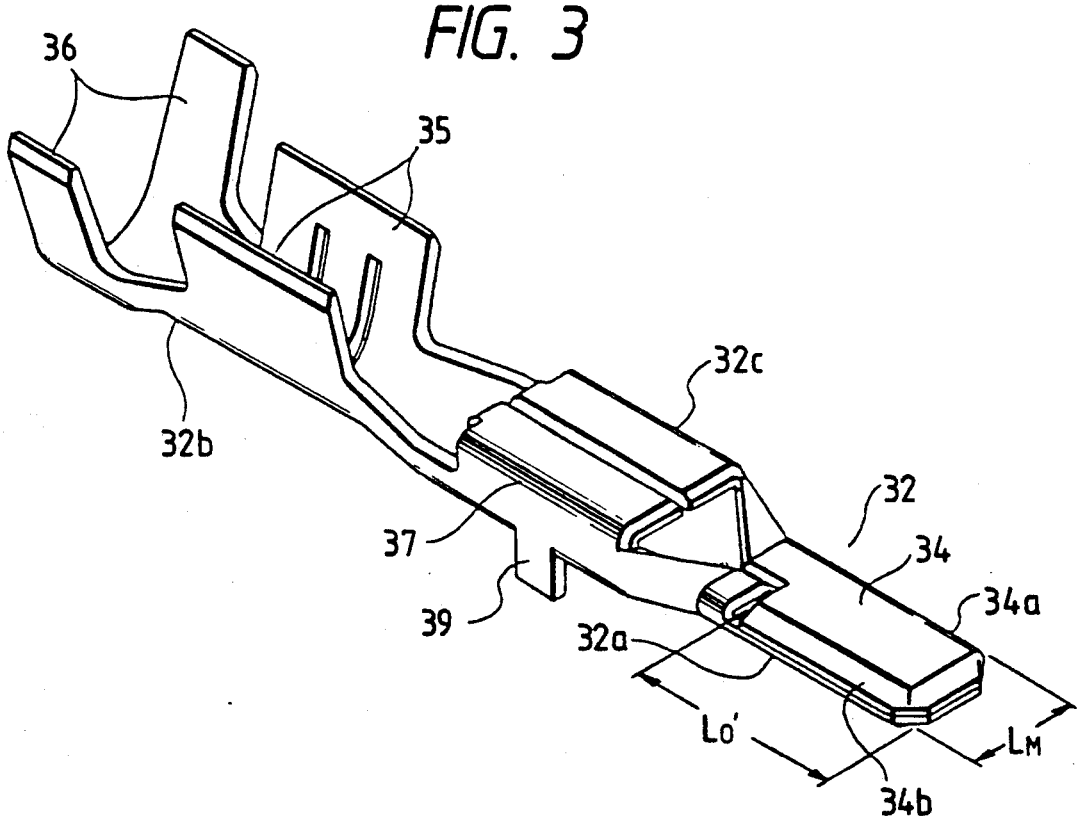
FIG. 3 is a perspective view of each of the male terminals of the connector.
Figure 4:
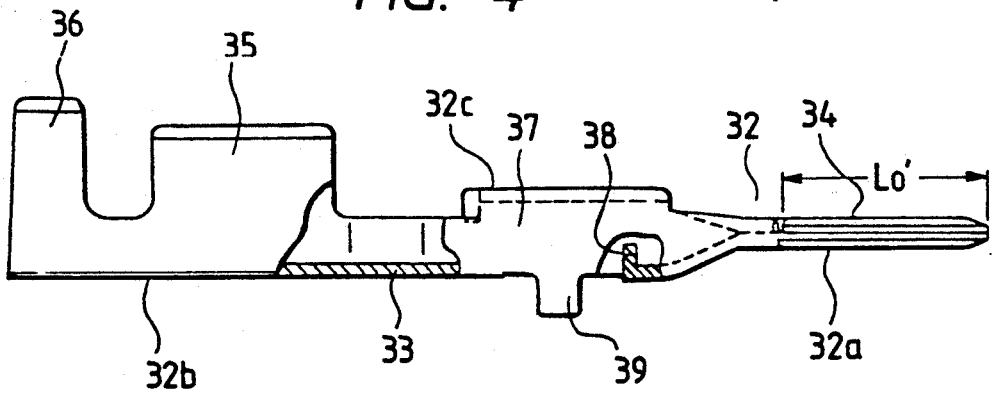
FIG. 4 is a cutaway side view of each of the male terminals.

The push member 26 has a cam rod 28 extending from the central portion of a conjoining bar 27, and guide arms 29 extending from both ends of the conjoining bar 27 and facing both the sides of the cam rod 28. The cam rod 28, which is a rigid body, has an upper support portion **28*a*, an intermediate oblique portion 28*b* having an inserting oblique surface P and a pulling-out oblique surface Q extending opposite thereto, and a lower contact surface pushing portion 28*c*, as shown in FIG. 2A. Each of the guide arms 29 has a stationary engagement projection 30 on an upper portion of an inside surface of the arm, and a tentative engagement projection 31 on the lower portion of the inside surface thereof FIG. 3 is a perspective view of each of the male terminals 32, and FIG. 4 is a cutaway side view of each male terminal 32. The male terminal 32 has a base plate 33, an electroconductive contact portion 32*a* at the tip of the base plate, an electric wire connecting portion 32*b* at the butt of the base plate, and a reinforcing portion 32*c* at an intermediate portion of the base plate 33. The electroconductive contact portion 32*a* is a tab-like portion 34 formed by bending side edge portions of the tip part of the base plate 33 onto each other. The electric wire connecting portion 32*b* has a pair of conductor caulking parts-35 and a pair of insulator caulking parts 36. The reinforcing portion 32*c* is formed by bending the side edge portions 37 of the intermediate part of the base plate 33 toward each other cylindrically, and has an engagement projection 38 formed by cutting and upwardly bending the base plate 33, and stabilizers 39** extending down from both sides of the reinforcing portion.

Figure 5:
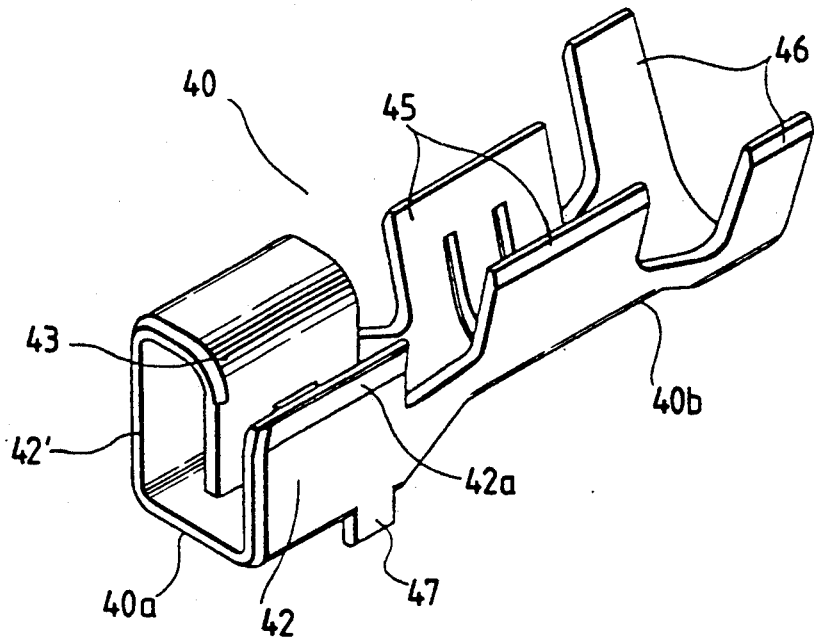
FIG. 5 is a perspective view of each of the female terminals of the connector.
Figure 6:
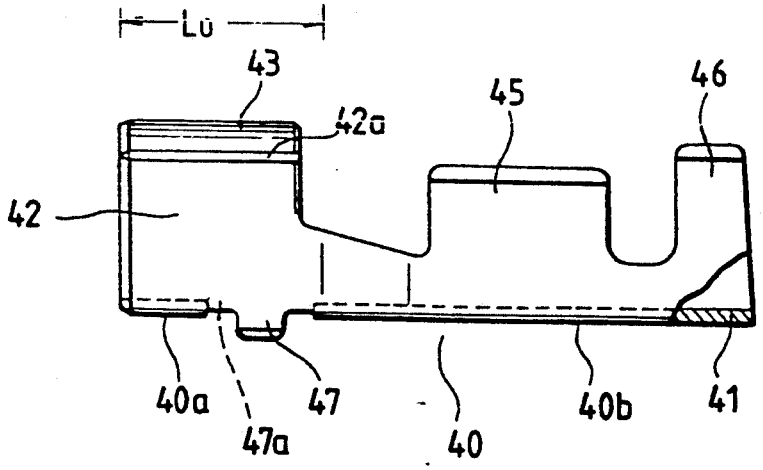
FIG. 6 is a cutaway side view of each of the female terminals.
Figure 7A:
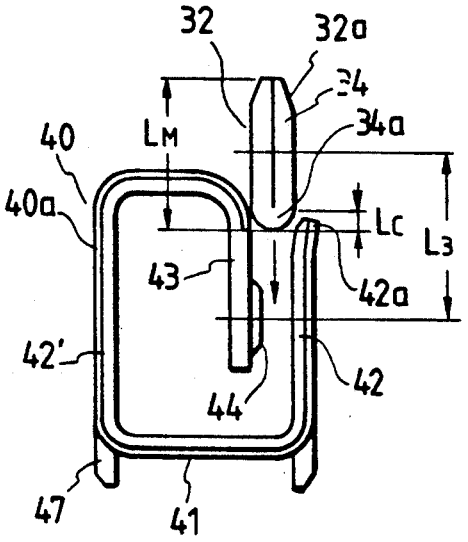
FIGS. 7A, 7B and 7C are views for explaining how the male and the female terminals are connected electrically to each other.
Figure 7B:
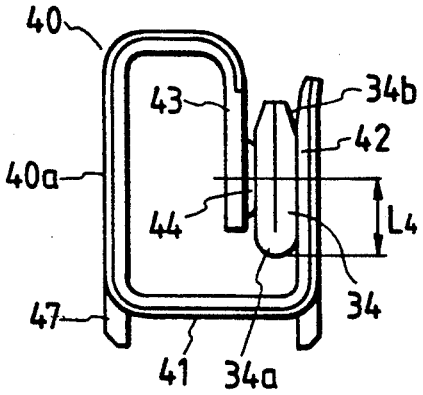
Figure 7C:
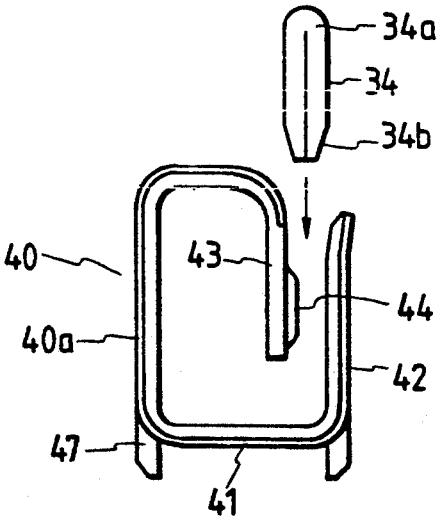

FIG. 5 is a perspective view of each of the female terminals 40, and FIG. 6 is a cutaway side view of each female terminal 40. The female terminal 40 has a base plate 41, an electroconductive contact portion 40*a* at the tip of the base plate 41, and an electric wire connecting portion 40*b* at the butt of the base plate 41. The electroconductive contact portion 40*a* has side walls 42 and 42, at both side edges of the base plate 41, and is bent in a U shape toward the base plate over the side wall 42' so that the electroconductive contact portion 40*a* is formed with an elastic contact part 43 facing the other side wall 42. A projection 44 is provided on the elastic contact part 43, as shown in FIGS. 7A, 7B and 7C. The upper portion of the side wall 42 is bent outwardly as an inserting guide 42*a*. The electric wire connecting portion 40*b* has a pair of conductor caulking parts 45 and a pair of insulator caulking parts 46. Stabilizers 47 extend down from both the sides of the electroconductive contact portion 40*a*.

The way in which each male/female terminal pair 32, 40 are electrically connected to each other now will be described in detail with reference to FIGS. 7A, 7B and 7C. The tab-like portion 34 of the male terminal 32 is inserted into the female terminal 40 through the gap between the upper portion of the side wall 42 thereof and the elastic contact part 43 thereof perpendicularly across the axis of the female terminal, starting with a bent-back part 34*a* of the tab-like portion, so that the tab-like portion is pinched between the side wall and the elastic contact part, thus electrically connecting the male and the female terminals to each other. In contrast, the tab-like portion 34 of the male terminal 32 also can be inserted into the female terminal 40 through the gap between the upper portion of the side wall 42 thereof and the elastic contact part 43 thereof perpendicularly across the axis of the female terminal, starting with the gradually thinned part 34*b* of the tab-like portion as shown in FIG. 7C, so that the tab-like portion is pinched between the side wall and the elastic contact part, thus electrically connecting the male and the female terminals to each other. In that case, the gradually thinned part 34*b* comes smoothly into contact with the projection 44 so that the insertion of the male terminal 32 into the female terminal 40 does not feel strongly resisted, but rather feels smooth.

Before the electric connection, the male and the female terminals 32 and 40 are located at a distance $L_c$ from each other, as shown in FIG. 7A. The length Lf' of the fitting stroke necessary to connect the male and female terminals 32 and 40 to each other electrically is expressed as follows:

$$Lf' = L_3 + L_4$$

$$L_3 = L_M + L_c$$

Figure 20A:
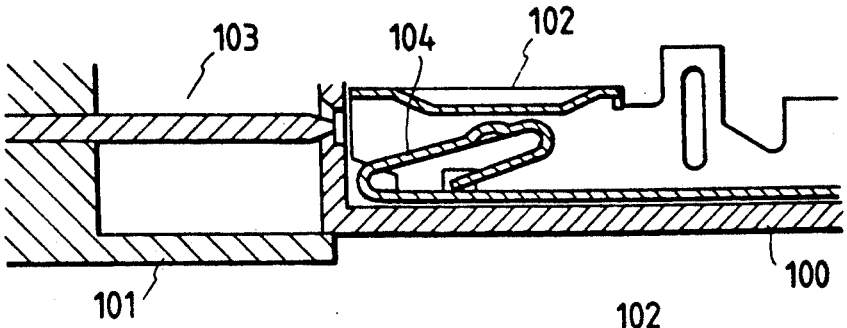
FIG. 20A PRIOR ART
FIGS. 20A and 20B are sectional views of major parts of a conventional multi-terminal electric connector before and after the electric connection of the male and female terminals thereof, respectively.
Figure 20B:
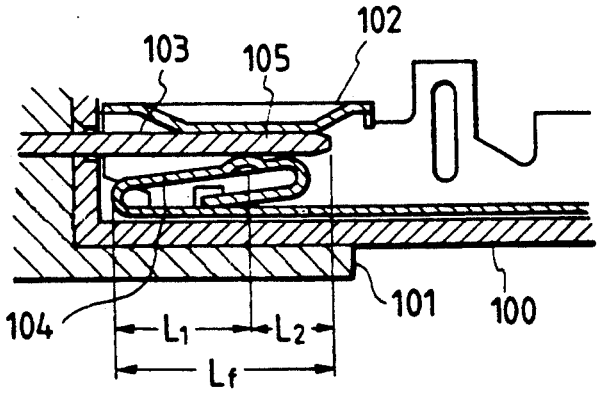
FIG. 20B PRIOR ART
Figure 21A:
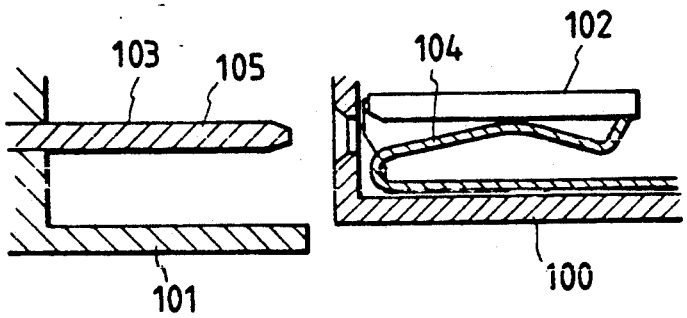
FIG. 21A PRIOR ART
FIGS. 21A and 21B are sectional views of major parts of another conventional multi-terminal electric connector before and after the electric connection of the male and female terminals thereof, respectively.
Figure 21B:
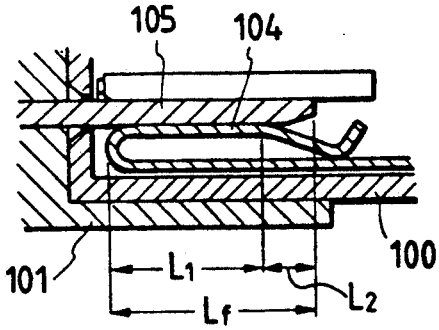
FIG. 21B PRIOR ART

In the equations, $L_M$, $L_3$ and $L_4$ denote the width of the tab-like portion 34, the distance between the center line 0 of the tab-like portion and the fitting center line 0' of the elastic contact part 43, and the distance between the fitting center line 0, and the side edge of the bent-back part or gradually thinned part of the tab-like portion, respectively. If the length Lf' ($Lf' = L_3 + L_4$) of the fitting stroke is compared with the length Lf ($Lf = L_1 + L_2$) of the fitting stroke necessary to electrically connect the male and female terminals 103 and 102 of the conventional electric connectors which are shown in FIGS. 20 and 21 and are of the type in which the terminals are fitted to each other in the axial direction of the connector, it can be seen clearly that the length Lf' is much shorter than Lf.

Fitting the male and the female units M and F to each other to connect the male and the female terminals 32 and 40 to each other electrically now will be described in detail. The female terminals 40 coupled to the ends of electric wires 48 are inserted into the female terminal chambers 2 of the male casing 1 of the male unit M so that the engagement projections 3 in the chambers are engaged in the engagement grooves 47*a* of the female terminals to hold the terminals in the chambers, as shown in FIG. 2A. The male unit M thus is assembled. The male terminals 32 are inserted into the male terminal chambers 15 of the male casing 13 of the female unit F so that the engagement projections 38 are engaged with engagement arms provided on the inside surfaces of the chambers but not shown in the drawings, to hold the terminals in the chambers, as shown in FIG. 2B. The female unit F thus is assembled.

The surfaces of the base plates 33 and 41 of the male and the female terminals 32 and 40 extend perpendicularly across each other in the male and the female units M and F. When the male unit M is fitted in the female unit F so that the upward movement preventive juts 9 of the male unit M are put into the guide grooves 20 of the covering portion 19 of the female unit F, the withdrawal preventive projections 10 are engaged with the withdrawal preventive locking parts 22 so that the male and the female units are locked to each other, as shown in FIG. 2B. As a result, the male and the female units are prevented from easily separating from each other.

When the male and the female units M and F thus are locked to each other, the engagement projection 23 on the fitting surface 14*a* of the female unit is engaged in the tentative engagement groove 11 of the male unit to prevent the male unit from moving relative to the female unit in a direction shown by an arrow in FIG. 2B. At that time, the electroconductive contact portions 32*a* and 40*a* of the male and the female terminals 32 and 40 are not yet in contact with each other, as shown in FIG. 7A. For that reason, the force for inserting the male unit M into the female unit F to fit them to each other in a mutually locked state needs to be only slightly higher than the resistive force which the withdrawal preventive projections 10 of the male unit receive when being engaged with the withdrawal preventive locking parts 22 of the female unit. Therefore, the inserting force is much lower than that for the conventional electric connectors shown in FIGS. 20 and 21.

Figure 2C:
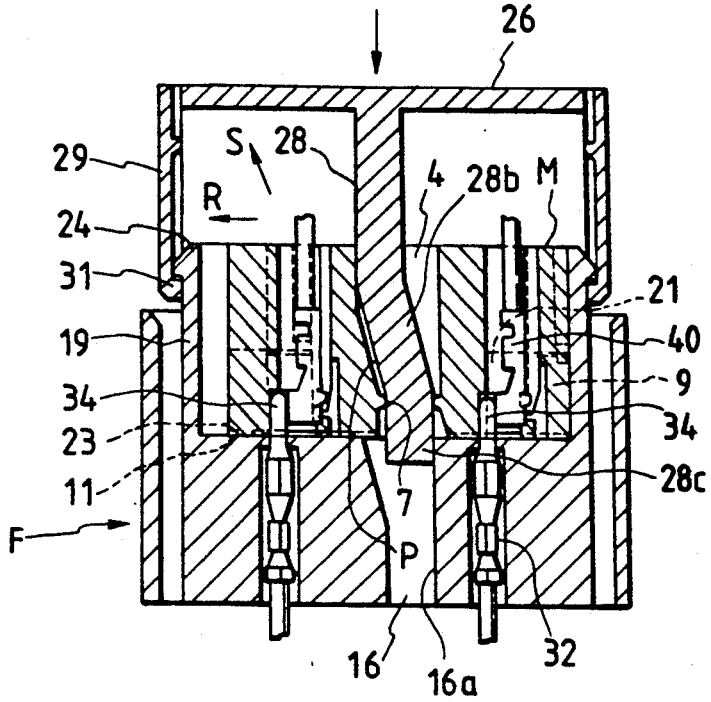

The cam rod 28 of the push member 26 is inserted into the cam holes 4 and 16 of the male and the female units M and F, as shown in FIG. 2C. At the same time, the tentative engagement projections 31 of both the guide arms 29 of the push member are engaged with the locking claws 24 of the top of the covering portion 19 so that the push member 26 is tentatively locked. At that time, the inserting oblique surface of the oblique portion 28*b* of the cam rod 28 is not yet in contact with the inserting projection 7 in the cam hole 4, and the male and the female terminals 32 and 40 still are not in contact with each other. The push member 26 is pressed down thereafter, as shown by an arrow in FIG. 2C. As a result, the lower contact surface pushing portion 28*c* of the cam rod 28 is moved more deeply inwardly while being guided on the inside vertical surface 16*a* of the cam hole 16, so that the inserting oblique surface P of the cam rod comes into contact with the inserting projection 7.

Because of the contact of the oblique surface P with the projection 7., the male unit M is slid horizontally in a direction R inside the covering portion 19 of the female unit F, so that the tab-like portion 34 of each male terminal 32 is moved in between the side wall 42 and elastic contact part 43 of the female terminal 40. Although the male unit M would be likely to move upwardly relative to the female unit F in a direction S when the male terminal 32 has begun to come into contact with the female terminal 40, the upward movement preventive juts 9 located in the upward movement preventive grooves 21 of the inside surface of the covering portion 19 prevent the male unit M from moving upwardly relative to the female unit F. The male unit M thus can be slid smoothly horizontally in the female unit F. Because of the horizontal sliding, the engagement projection 23 of the female unit F is disengaged from the tentative engagement groove 11 of the male unit M.

Figure 2D:
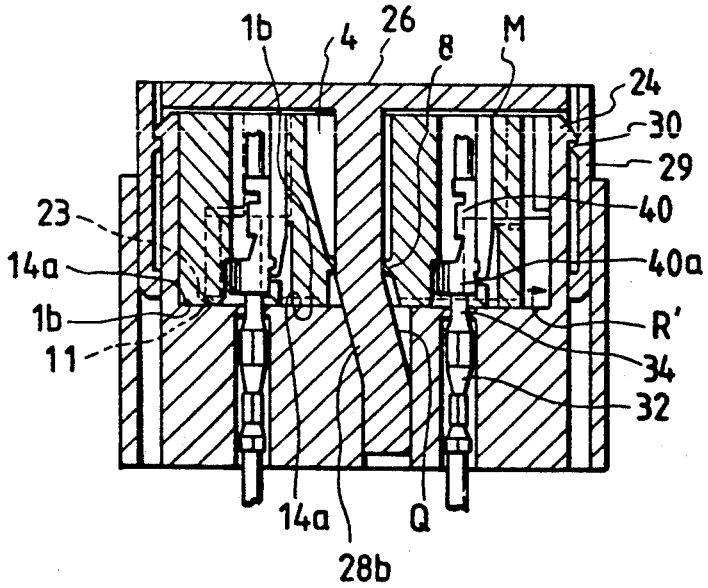

FIG. 2D shows a state in which the push member 26 is completely pressed in, the male and the female units M and F are fitted completely to each other, and the male and the female terminals 32 and 40 are electrically connected to each other completely. In that state, the tab-like portion 34 of the male terminal 32 is inserted and pinched between the side wall 42 and elastic contact part 43 of the electroconductive contact portion 40*a* of the female terminal 40, as shown in FIG. 7B. Besides, the engagement projection 23 is engaged in the stationary engagement groove 12, the male and the female units M and F are locked to each other at the fitting surfaces 1*b* and 4*a* thereof, and the stationary engagement projections 30 of the guide arms 29 of the push member 26 are engaged with the locking claws 24 at the top of the covering portion 19 of the female unit so that the guide arms are locked.

When the male and the female units M and F are to be separated from each other, the steps described above with reference to FIGS. 2A, 2B, 2C and 2D are reversed. At that time, the male unit M is slid horizontally relative to the female unit F in a direction R' because the pulling-out oblique surface Q of the oblique portion 28*b* of the push member 26 is moved on the pulling-out projection 8 in the cam hole 4.

Instead of providing the inserting projection 7 and the pulling-out projection 8, the inside oblique surfaces 4*d* and 4*b* of the cam hole 4 may be used as slide contact portions on which the oblique portion 28*b* of the cam rod 28 is moved to slide the male unit M horizontally relative to the female unit F.

Figure 9A:
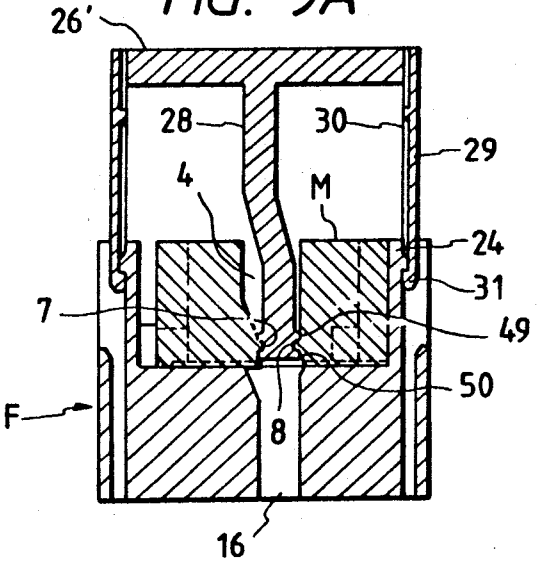
FIGS. 9A and 9B are sectional views for describing the states of the connector shown in FIG. 8.
Figure 9B:
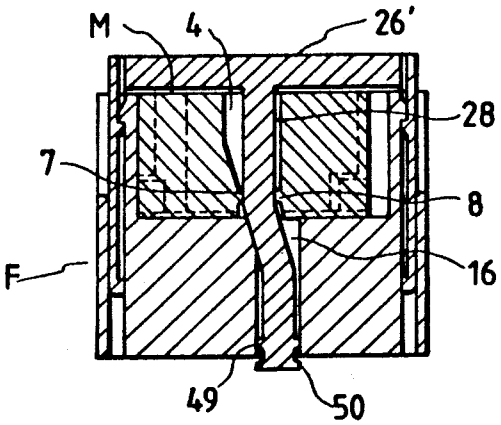
Figure 8:
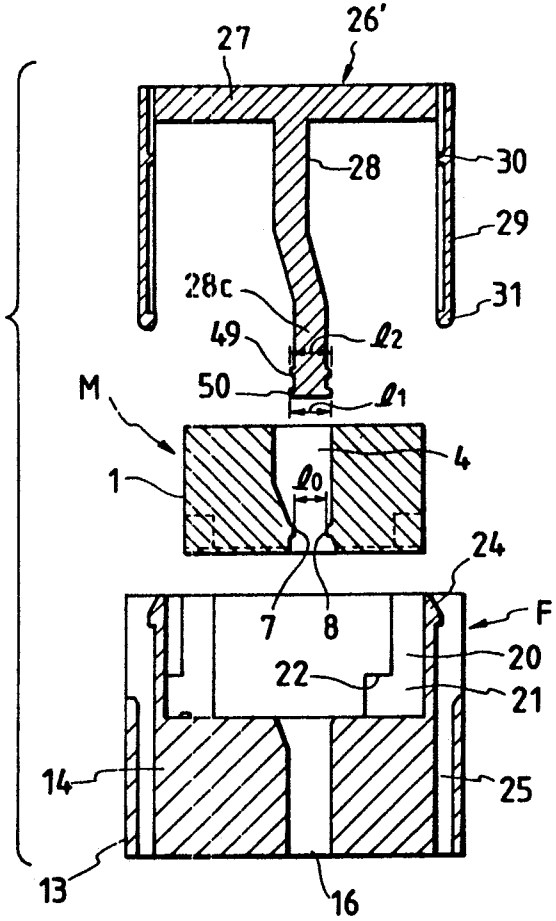
FIG. 8 is a sectional exploded view of a second embodiment of a multi-terminal electric connector according to the invention.

FIGS. 8, 9A and 9B show another embodiment of the inventive multi-terminal electric connector. The difference between this electric connector and that shown in FIG. 1A is that the connector shown in FIG. 8 has a push member 26, having a cam rod 28 including a lower contact surface pushing portion 28*c* provided with two engagement projections 49 and 50. Each of the distance $l_1$ between the tips of the engagement projections 50 and the distance $l_2$ between the tips of the engagement projections 49 is made slightly larger than the distance $l_0$ between an insertion projection 7 and a removal projection 8. The distance $l_1$ is made larger than the distance $l_2$ so as to prevent the push member 26' from coming off easily from the male unit M of the connector. The female and male terminal chambers 15 and 2 and female and male terminals 32 and 40 of the male and female units M and F of the connector are not shown in the drawings, for ease of depiction.

FIGS. 9A and 9B are sectional views for describing the steps of fitting the male and female units M and F to each other with the use of the push member 26'. As shown in FIG. 9A, the engagement projections 49 and 50 of the cam rod 28 are engaged with the insertion and removal projections 7 and 8 in the cam hole 4 of the male unit M to lock the push member to the male unit M to make it possible to handle them together conveniently. Fitting the male and the female units M and F to each other, separating them from each other, and the actions of the push member 26, are the same as those described above with reference to FIGS. 2A, 2B, 2C and 2D.

Figure 10A:
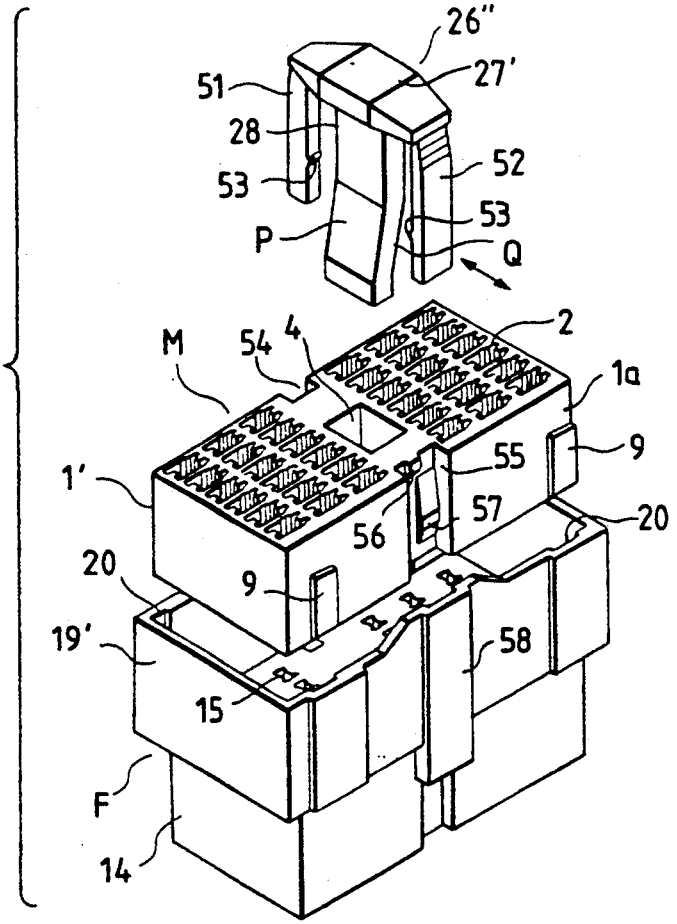
FIGS. 10A, 10B and 10C are perspective exploded views of a third embodiment of a multi-terminal electric connector according to the invention.
Figure 10B:
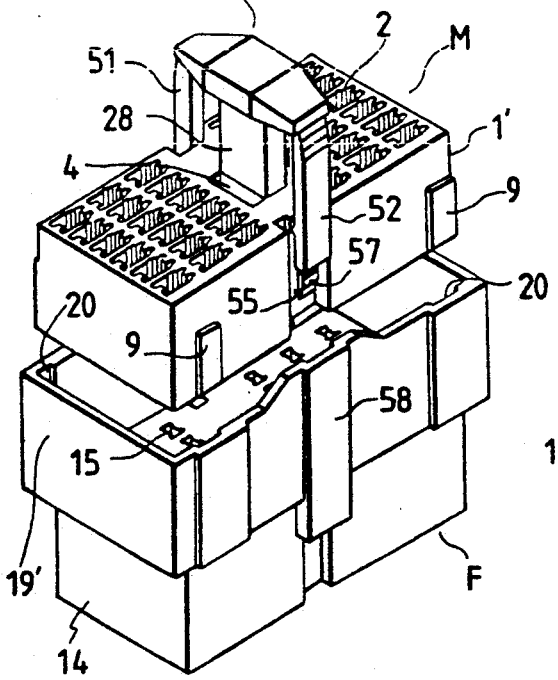
Figure 10C:
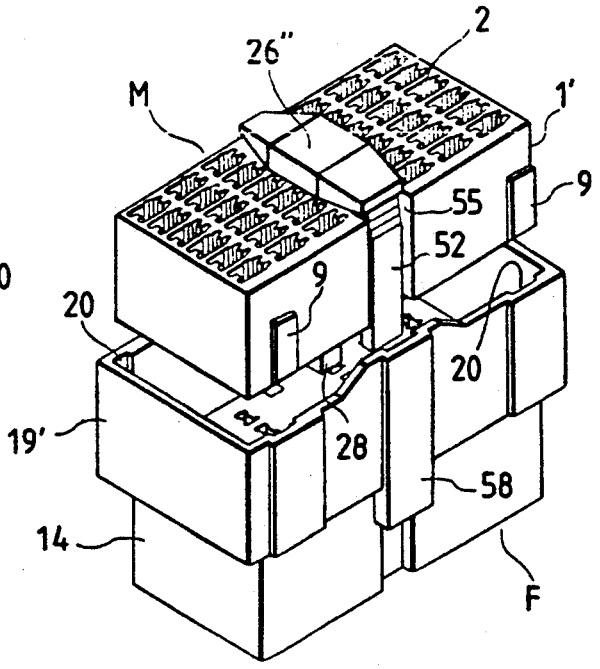

FIGS. 10A, 10B and 10C are perspective exploded views of yet another embodiment of the inventive multi-terminal electric connector. FIGS. 11A, 11B, 11C, 11D and 11E are sectional views of the connector, and describe the steps of fitting the male and female units M and F of the connector to each other. The push member 26'' of the connector has a conjoining bar 27'', a cam rod 28 extending from the central portion of the bar 27'', and guide arms 51 and 52 extending from both ends of the bar and facing the side edges of the insertion oblique surface P and removal oblique surface Q of the cam rod. Although it is preferable that the guide arms 51 and 52 be made asymmetrical as shown in the drawings, they also may be made symmetrical.

Engagement projections 53 are provided on the inside surfaces of the guide arms 51 and 52. The central portions of both the longitudinal sides 1*a* of the male casing 1' of the male unit M of the connector have arm guide grooves 54 and 55 extending vertically, stationary engagement- projections 56 at upper portions of the grooves, and tentative engagement projections 57 at lower portions of the grooves. The covering portion 19' of the female unit F of the connector has arm covering parts 58 protruded from the other parts of the covering portion and corresponding to the arm guide grooves 54 and 55 of the male unit M. The remaining connector construction is the same as that of the connector shown in FIG. 1A. Other portions of the connector are denoted by the same reference symbols as the connector shown in FIG. 1A.

Figure 11A:
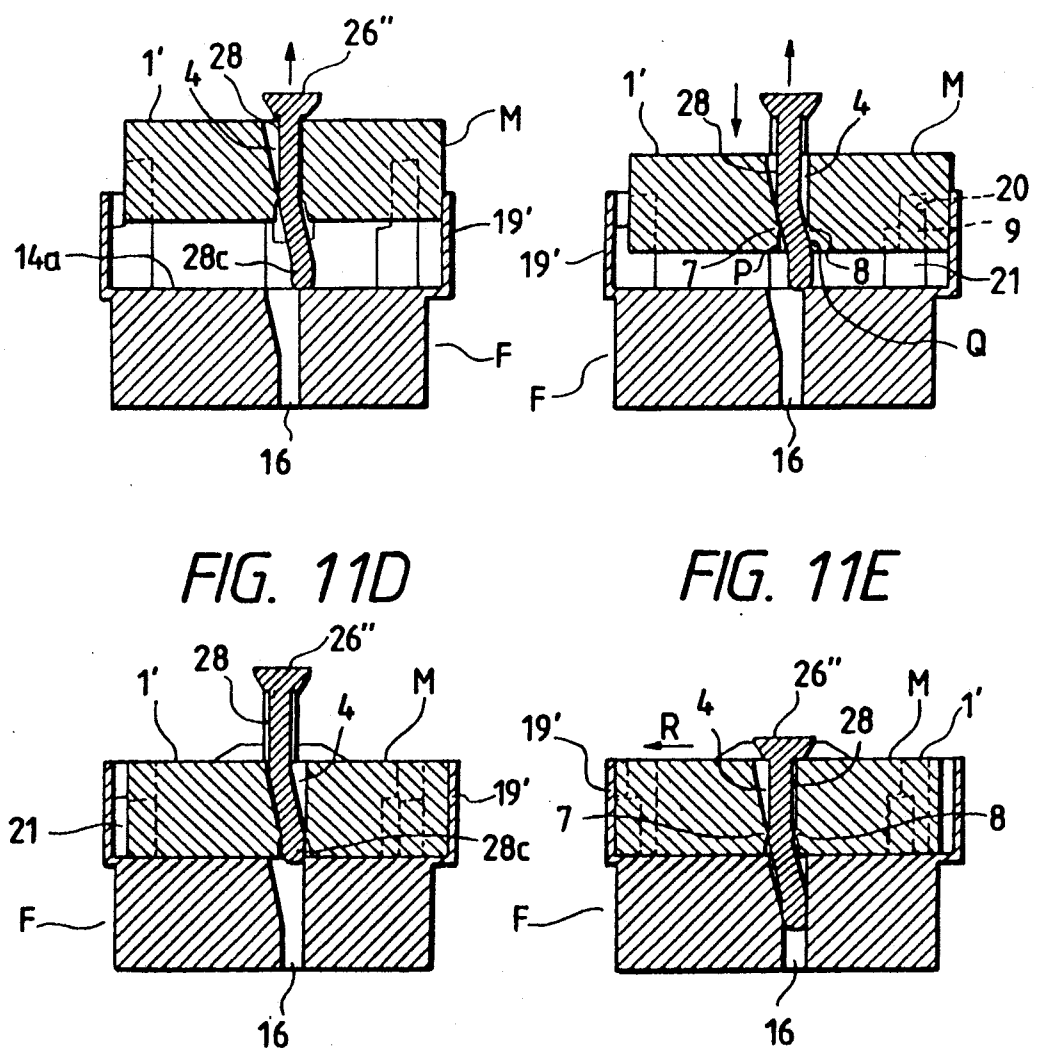

Fitting the male and female units M and F of the connector using the push member 26'' is performed as now will be described. The cam rod 28 of the push member 26'' first is inserted into the cam hole 4 of the male unit M so that the lower contact surface pushing portion 28*c* of the cam rod projects from the fitting surface 1*a* of the male unit, as shown in FIG. 11A. At the same time, the guide arms 51 and 52 of the push member 26'' are fitted in the arm guide grooves 54 and 55 of the male casing 1' of the male unit M, and the engagement projections 53 on the inside surfaces of the guide arms are engaged with the tentative engagement projections 57 at the grooves, so that the push member is locked on the male unit M, as shown in FIG. 10C. The male unit M then is inserted into the female unit F so that the upward movement preventive juts 9 of the male unit M are fitted into the guide grooves 20 of the inside surface of the covering portion 19' of the female unit. As a result, the tip of the lower contact surface pushing portion 28*c* of the push member 26'' comes into contact with the fitting surface 14*a* of the female unit F, as shown in FIG. 11B.

When the male unit M is pressed down further, as shown in FIG. 11C, the upward movement preventive juts 9 are inserted directly into the guide grooves 20 so that the engagement projections 53 of the push member 26" are disengaged from the stationary engagement projections 56, and the insertion and removal of oblique surfaces P and Q of the push member 26" are moved on the insertion and removal projections 7 and 8 of the male unit. At that time, the push member 26" is moved upwardly relative to the male unit M, and the cam rod 28 of the push member 26" is slid so as to be located closer to the cam hole 16 of the female unit F.

When the male unit M is completely inserted into the covering portion 19' of the female unit F, as shown in FIG. 11D, the contact surface pushing portion 28c of the push member 26" is tightly fitted in the cam hole 16 of the female unit F. The state of the connector, which is shown in FIG. 11D, is nearly the same as that of the preceding connector, which is shown in FIG. 2C. In the state shown in FIG. 11D, the male and the female terminals 32 and 40 of the connector are not yet in contact with each other, similarly to the state shown in FIG. 7A. For that reason, the force for fitting the male and the female units M and F to each other needs to be only slightly higher than the force for disengaging the engagement projections 53 of the push member 26" from the tentative engagement projections 57 of the male unit M. In other words, the fitting force can be very low.

In the state shown in FIG. 11D, the engagement projections 53 of the push member 26" are engaged with the stationary engagement projections 56 in the arm guide grooves 54 and 55 so that the push member is prevented from coming off the male unit M. When the male unit M is slid in a direction R inside the covering portion 19' of the female unit F relative thereto by finally manipulating the push member 26", as shown in FIG. 11E, the male and the female terminal 32 and 40 are electrically connected to each other due to the same action as the step shown in FIG. 2D.

Figure 12:
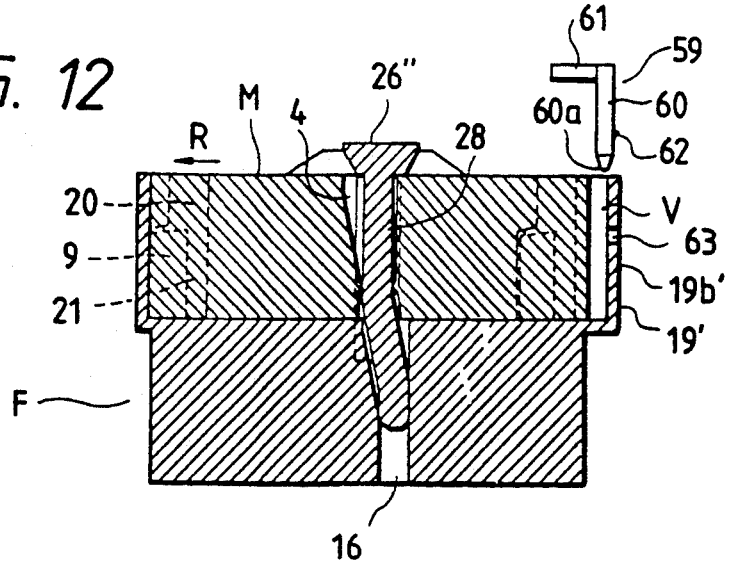
FIG. 12 is a sectional view of a fourth embodiment of a multi-terminal electric connector according to the invention.
Figure 13:
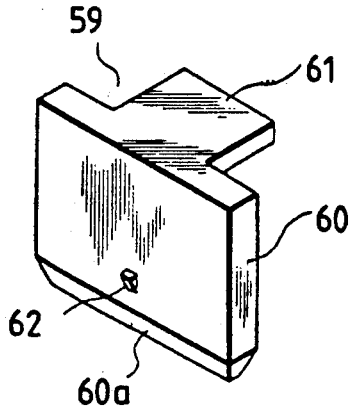
FIG. 13 is a perspective view of the fitting confirmation member of the connector shown in FIG. 12.
Figure 14:
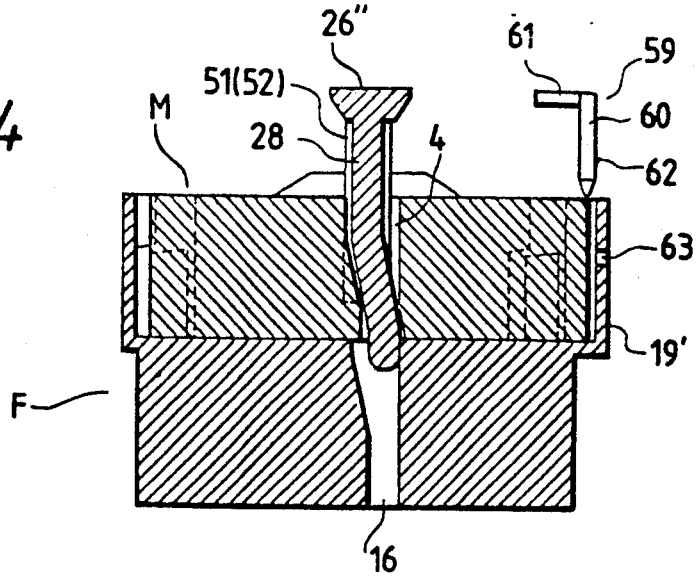
FIG. 14 is a sectional view of the connector shown in FIG. 12.

FIGS. 12, 13 and 14 show still another embodiment of the inventive multi-terminal electric connector, which includes a fitting confirmation member 59 for confirming the complete fitting of the male and female units M and F. The fitting confirmation member 59 has a plate body 60' a pushing portion 61 extending from the top of one side of the plate body, an engagement projection 62 provided on the other side of the plate body, and oblique surfaces 60a provided on the lower portion of the plate body so as to guide the plate body for insertion thereof. The covering portion 19' of the female unit F has an engagement part 63 in one end wall 19b' of the covering portion so that the engagement projection 62 of the fitting confirmation member 59 can be engaged in the engagement part.

FIG. 14 is a sectional view of the connector in a state in which the male and the female units M and F are not completely fitted to each other.

FIG. 12 corresponds to FIG. 11E and shows a state in which the male and the female units M and F are completely fitted to each other by manipulating the push member 26" of the connector. In that state, an opening V is made between the male unit M and the end wall 19b' of the covering portion 19, of the female unit F because the male unit is slid horizontally in a direction R inside the covering portion relative thereto. When the plate body 60 of the fitting confirmation member 59 is inserted into the opening V, the engagement projection 62 is engaged in the engagement part 63 so that the member is locked. However, if the manipulation of the push member 26" is stopped at an early stage, the opening V is not made completely and the fitting confirmation member 59 therefore cannot be inserted into it. For that reason, it can be determined whether the male and the female units M and F are fitted completely to each other. The fitting confirmation member 59 thus can be used to inspect the state of the fitting of the male and the female units M and F to prevent the incomplete fitting thereof and to ensure the locking of them to each other.

Figure 15A:
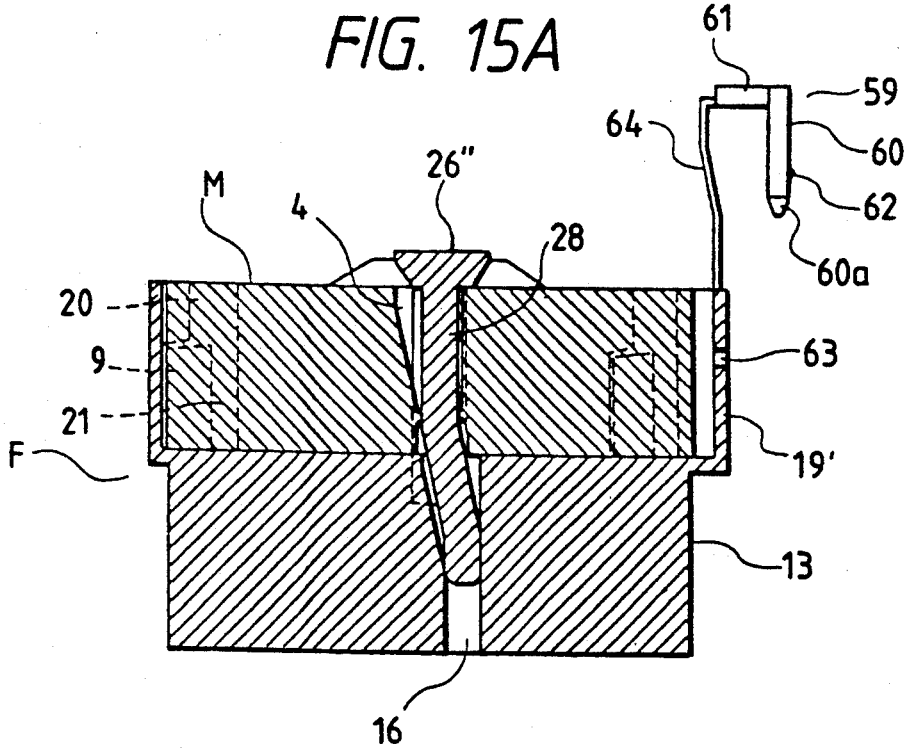
FIGS. 15A and 15B are sectional views of a fifth embodiment of a multi-terminal electric connector according to the invention.
Figure 15B:
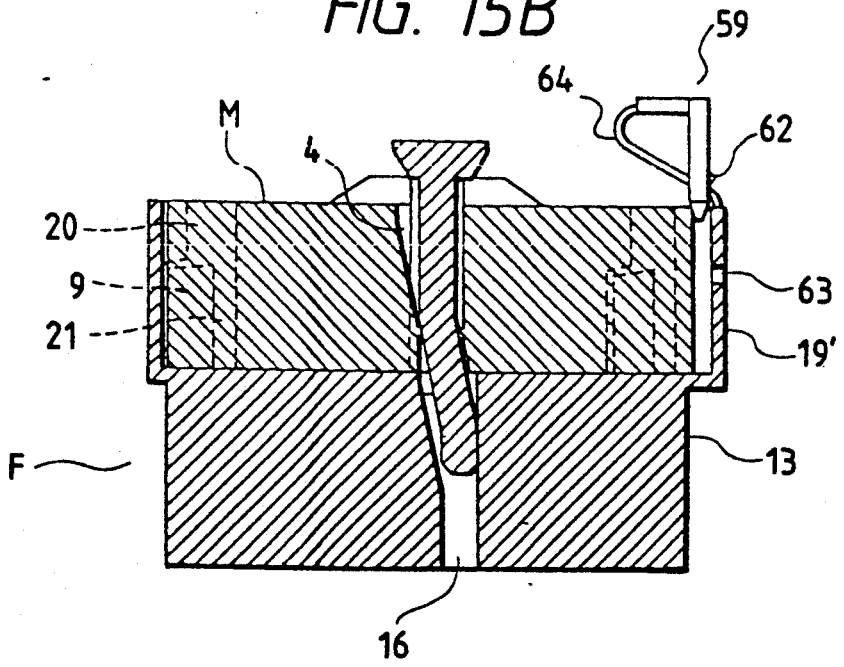

FIGS. 15A and 15B show a modification of the connector, in which the fitting confirmation member 59 is joined integrally to the female unit F. The pushing portion 62 of the member 59 is joined to the covering portion 19' of the female unit F by a coupler 64 made of a long flexible plastic ribbon. For joining, both ends of the coupler 64 are fastened to the fitting confirmation member 59 and the female casing 13 of the female unit F by ultrasonic fuse-bonding or the like. The fitting confirmation member 59, the coupler 64 and the female casing 13 may be molded together.

Since the fitting confirmation member 59 remains joined to the female unit F in each of the connector and the modification thereof, the member can be handled conveniently and forgeting to insert the member into the opening V can be prevented.

Figure 16B:
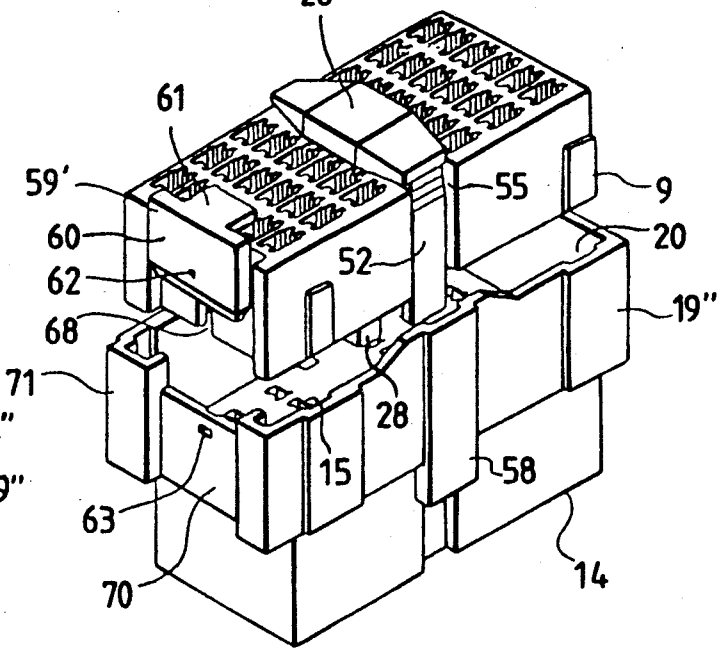
FIGS. 16A and 16B are perspective exploded views of a sixth embodiment- of a multi-terminal electric connector according to the invention.
Figure 16A:
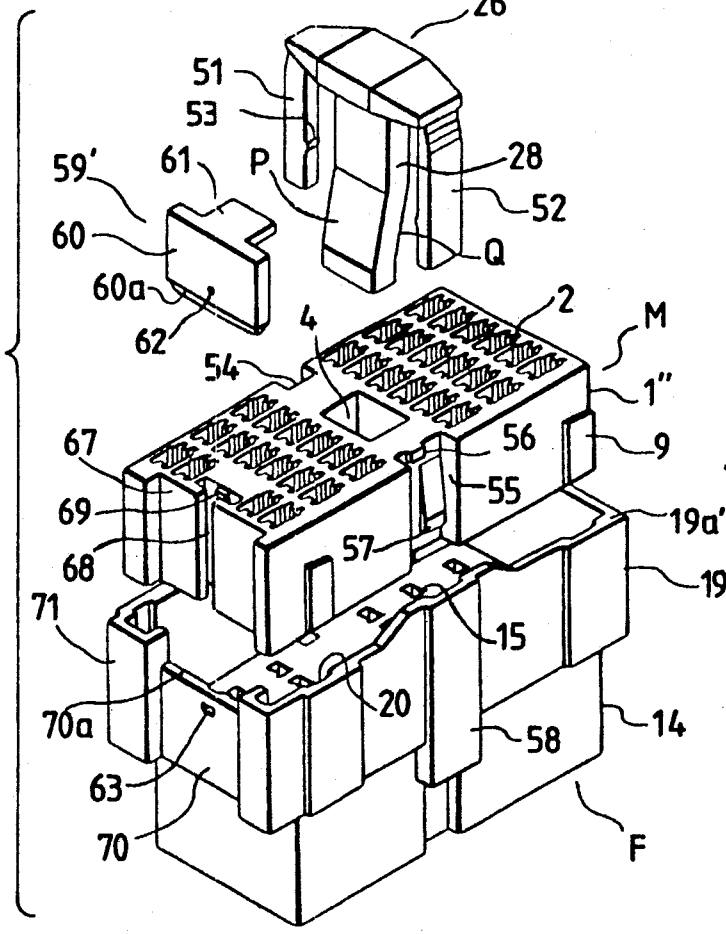
Figure 17B:
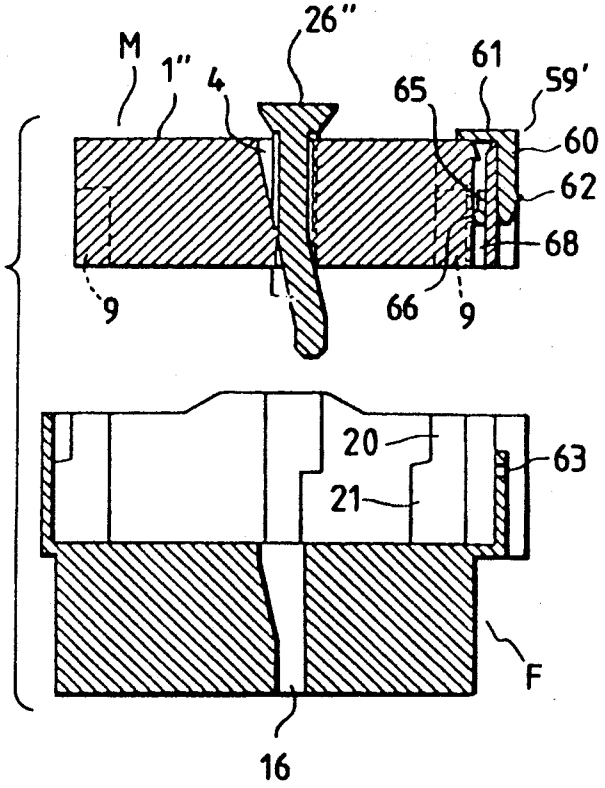
FIGS. 17A and. 17B are sectional views of the connector, corresponding to FIGS. 16A and 16B.
Figure 17A:
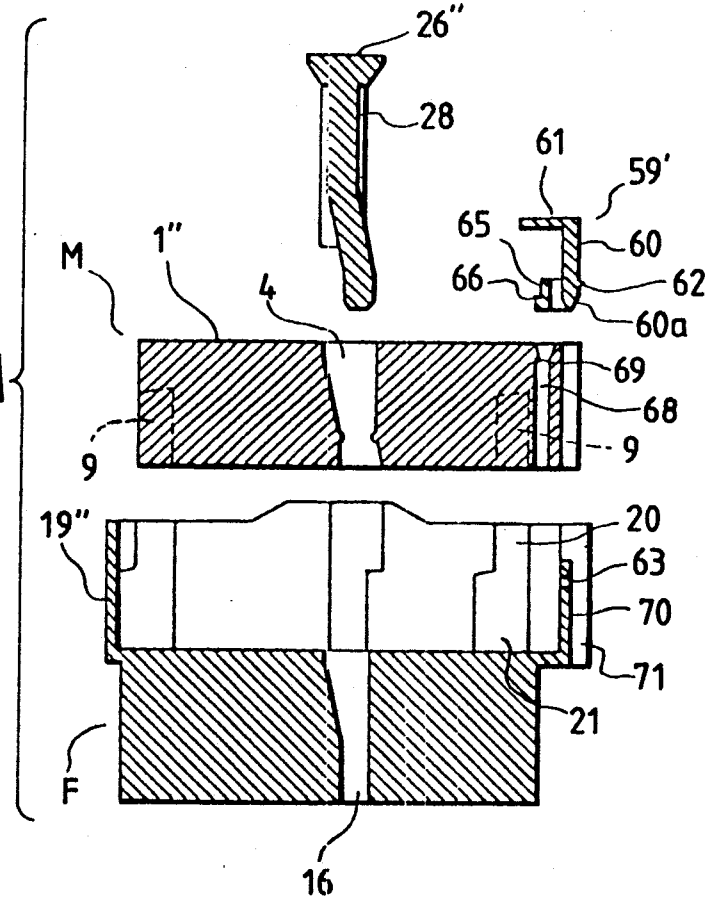

FIGS. 16A and 16B are perspective views of yet another embodiment of the inventive multi-terminal electric connector, in which a fitting confirmation member 59' is locked to the male unit M of the connector so that the member is held on the male unit M. FIGS. 17A and 17B are sectional views of the connector, which correspond to the perspective views of FIGS. 16A and 16B. The fitting confirmation member 59' has a plate body 60, a pushing portion 61 extending from the top of one side of the plate body, an inserted portion 65 extending from the lower portion of that side and having a T-shaped cross section, and an engagement projection 66 provided on the inner side of the inserted portion. One end wall 67 of the male casing 1' of the male unit M is a recessed wall and has an insertion opening 68, into which the inserted portion 65 is inserted. An engagement projection 69 is provided on the insertion opening 68 at the top thereof.

One end wall 70 of the covering portion 19" of the female unit F of the connector has guide portions 71 provided at both ends of the wall so as to guide the recessed wall 67 of the male unit M. The top 70a of the end wall 70 is lower than the top 19a" of the covering portion 19". The inserted portion 65 of the fitting confirmation member 59' is inserted into the insertion opening 68 of the male unit M so that the member is fitted in the recess wall 67. As a result, the male unit M and the member 59' can be handled together. Since the engagement projection 66 on the inserted portion 65 is engaged with the engagement projection 69 in the insertion opening 68, the fitting confirmation member 59' is prevented from easily coming off the male unit M.

Figure 18A:
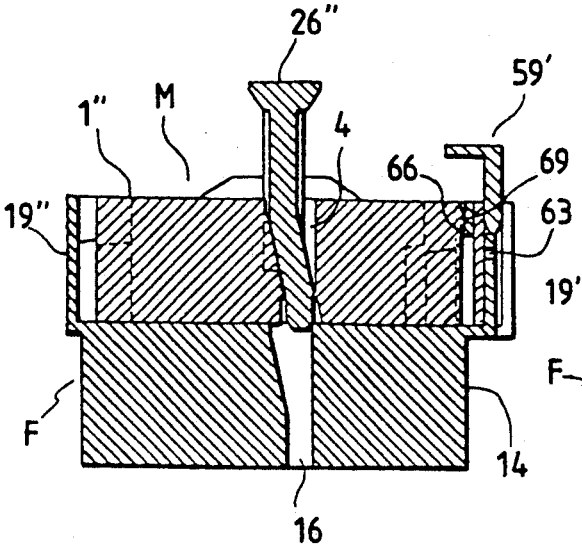
FIGS. 18A and 18B are sectional views for describing the states of the connector shown in FIG. 16A.
Figure 18B:
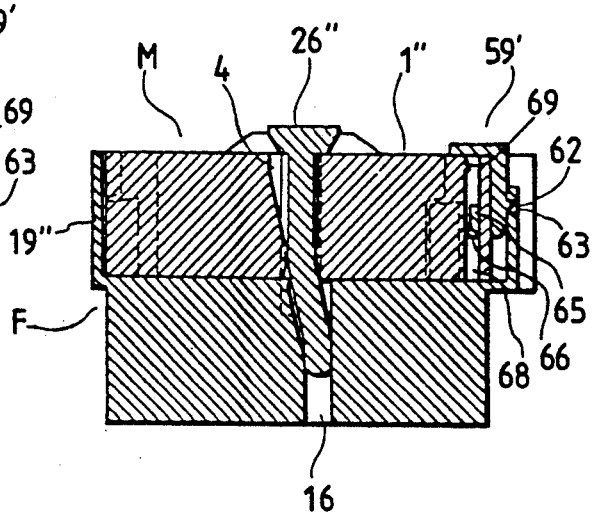

FIGS. 18A and 18B show states of the fitting confirmation member 59' in fitting the male and the female units M and F to each other by manipulating the push member 26" of the connector. FIG. 18A corresponds to FIG. 11D, and shows a state in which the fitting confirmation member 59' is pulled up and tentatively locked by the engagement projection 66 thereof and the engagement projection 69. When the push member 26" is pressed down in that state so as to fit the male and the female units M and F to each other and thus electrically connect the male and female terminals 32 and 40 of the connector to each other, the male unit is slid horizontally so that an opening V is made between the end wall 70 of the covering portion 19'' and the recessed wall 67 of the male casing 1'' of the male unit as shown in FIG. 18B. After that, the member 59' is pushed down into the opening V so that the engagement projection 62 thereof is engaged with the engagement part 63 of the covering portion 19'' to lock the member.

The male and female units of a multi-terminal electric connector provided in accordance with the present invention can be fitted to each other with nearly zero force to insert the male unit into the female unit. Besides, the male terminals of the female unit can be inserted into and removed from the female terminals of the male unit by forces much lower than those for the conventional multi-terminal electric connectors mentioned above.

The horizontal sliding of the male unit relative to the female unit by manipulating a push member constituting a part of a cam mechanism does not require a tool such as an impact wrench for a screw-tightened electric connector having a very large number of terminals. As a result, the handling of the connector provided in accordance with the present invention is more efficient than that of the screw-tightened electric connector. However, the internal constitution of the male and female casings of the inventive connector is similar to that of the screw-tightened electric connector to make the cost of the former connector lower than that of the latter.

Since the male terminals of the inventive connector are inserted into and pulled out of the female terminals thereof as the axes of the male and the female terminals extend perpendicularly across each other, the area of the electroconductive contact of the terminals can be made sufficiently large, even if the length of the stroke of each of the insertion and removal is made small. If a fitting confirmation member is used, the incomplete fitting of the male and the female units of the connector can be prevented from being left, to heighten the reliability of the electric connection of the male and the female terminals.

Figure 19:
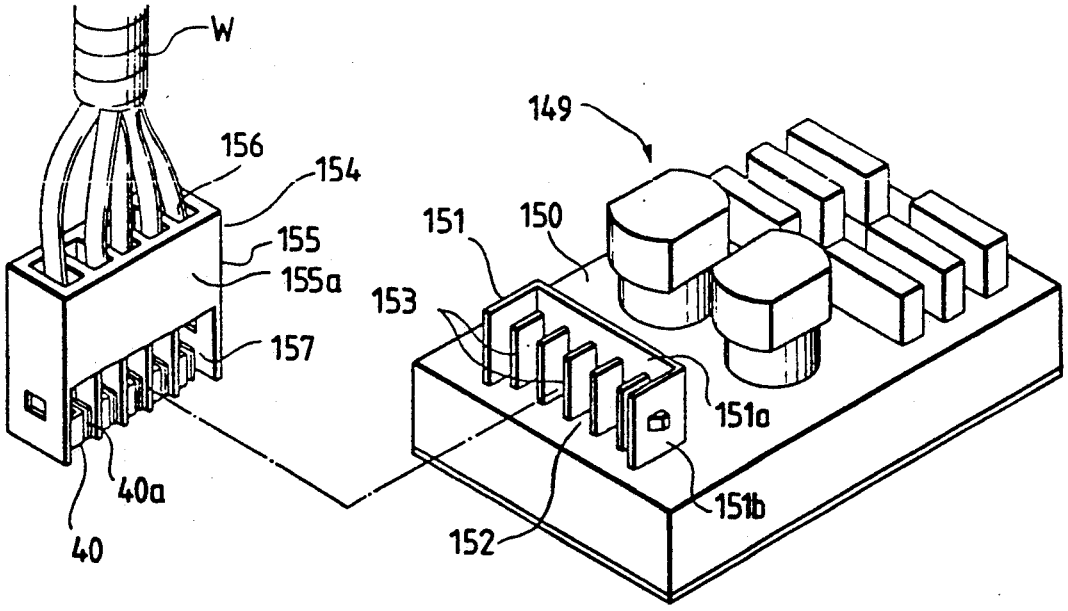
FIG. 19 shows another application of the female terminals.

FIG. 19 shows another application of the female terminals 40. An electric connection box 149 has a main cover 150 provided with the male casing 151 of an electric connector 154. The male casing 151 is made of a nearly U-shaped frame and has a longitudinal wall 151*a* and end walls 151*b* so that the male casing 151 has an opening 152. A plurality of tab-like terminals 153 are provided on a circuit board provided in the electric connection box 149 but not shown in FIG. 19, and are juxtaposed inside the male casing 151 so that the tab-like terminals extend parallel to the end walls 151*b* of the male casing 151.

The female terminals 40 are inserted in the terminal chambers 156 of the female casing 155 of the electric connector 154, which is electrically connected to the end of an electric cord W. The female casing 155 is open at portion 157, under one longitudinal wall 155*a* of the casing. The electroconductive contact portions 40*a* of the female terminals 40 are juxtaposed in the female casing 155 at the opening 157 of the casing 155. The female casing 155 is fitted on the end walls 151*b* of the male casing 151, as shown by a dotted line in FIG. 19, so that the female terminals 40 are connected electrically to the tab-like terminals 153. For that reason, the connector can be put easily into electric connection, even within a narrow space in a motor vehicle or the like.

A female terminal provided for an electric connector in accordance with the present invention enables the tab-like portion of a male terminal to be inserted into the female terminal in a direction perpendicularly crossing the surface of the base plate of the female terminal. For that reason, the length of the stroke of the fitting of the male and the female terminals can be made small, and the male terminal can be inserted into and pulled out of the female terminal with low force. As a result, the connector can be reduced in size. Since the area and pressure of the contact of the male and the female terminals can be made to be not smaller than those of a conventional electric connector, the female terminal is particularly appropriate for an electric connector having about twenty to about forty pairs of male and female terminals.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. In an electric connector comprising a male portion and a female portion, and at least one male terminal with a tab-shaped portion:

a female terminal, which is made from a thin metal sheet, said female terminal comprising:

an elongate plate member;

an electroconductive contact portion disposed at one axial position of said plate member for receiving the tab-shaped portion of said at least one male terminal into said contact portion; and an electrical wire connecting portion disposed at another axial position of said plate member for receiving an electrical wire extending in an axial direction of said plate member;

wherein said electroconductive contact portion includes a base portion, first and section side walls at both side edges of said base portion, and an elastic contact part formed by bending at least a portion of said first side wall towards said second side wall in a U shape such that said elastic contact portion is adjacent said second side wall and spaced a predetermined distance therefrom;

wherein said tab-like portion is inserted between said elastic contact part and said second side wall in a transverse direction perpendicular to said axial direction such that said tab-like portion of said male terminal extends in said transverse direction; and, wherein the bend formed by bending said first side wall in a U-shape extends in said axial direction.

2. A female terminal according to claim 1, wherein said male terminal is made from a thin metal sheet and includes a second base plate, an electroconductive contact portion at one part of said second base plate, and an electric wire connecting portion at another part of said second base plate;

wherein said electroconductive contract portion of said male terminal is formed as said tab-like portion by bending a free side edge part of said second base plate back onto said another part of said second base plate; and said tab-like portion is inserted into the electroconductive contact portion of said female terminal, starting with a part of said tab-like portion located opposite a bent-back part of said tab-like portion.

3. A female terminal according to claim 1 wherein said predetermined distance is less than a width of said tab-like portion extending in a direction perpendicular to both said transverse and axial directions.

4. The female terminal according to claim 1, wherein said elastic contact portion is substantially parallel to said second side wall.

* * * * *